US006069848A

United States Patent [19]

McDonald et al.

[11] Patent Number: 6,069,848

[45] Date of Patent: May 30, 2000

[54] LIFE TIME CLOCK

[75] Inventors: Thomas B. McDonald; Martin S. Cregg; Scott W. Osiecki, all of County of Onondaga, N.Y.

[73] Assignee: Bright Ideas Group, Inc., Skaneateles, N.Y.

[21] Appl. No.: 08/663,389

[22] Filed: Jun. 13, 1996

[51] Int. Cl.[7] ..... G04B 45/00

[52] U.S. Cl. ..... 368/107; 368/41

[58] Field of Search ..... 368/107–113, 10, 368/41

[56] References Cited

U.S. PATENT DOCUMENTS

| | | | |
|---|---|---|---|
| 4,223,526 | 9/1980 | Tanaka et al. | 368/84 |
| 4,518,267 | 5/1985 | Hepp | 368/107 |
| 4,630,935 | 12/1986 | Zettek | 368/41 |
| 4,652,139 | 3/1987 | Sulcer, Jr. | 368/9 |
| 4,906,982 | 3/1990 | Gwynn | 340/706 |
| 4,965,553 | 10/1990 | DelBiondo, II et al. | 340/573 |
| 5,023,850 | 6/1991 | Metts et al. | 368/28 |
| 5,031,161 | 7/1991 | Kendrick | 368/280 |
| 5,058,085 | 10/1991 | Lawler | 368/28 |
| 5,097,429 | 3/1992 | Wood et al. | 368/10 |
| 5,140,562 | 8/1992 | Moore-Ede et al. | 368/62 |
| 5,285,430 | 2/1994 | Decker | 368/281 |
| 5,337,290 | 8/1994 | Ventimiglia et al. | 368/10 |
| 5,357,487 | 10/1994 | Coleman, III | 368/10 |
| 5,365,494 | 11/1994 | Lynch | 368/10 |

FOREIGN PATENT DOCUMENTS

| | | | |
|---|---|---|---|
| 302828 | 12/1928 | United Kingdom | 368/96 |

*Primary Examiner*—Bernard Roskoski
*Attorney, Agent, or Firm*—Trapani & Molldrem

[57] ABSTRACT

A timepiece for measuring the lifetime of a personal life time event (e.g., marriage, birth, the start of a career) from the moment of occurrence of the personal life time event. The timepiece comprises a housing and a timer contained in the housing. The timer is configured for measuring the elapsed time of the personal life time event from the moment of occurrence. The timepiece includes a starting mechanism for causing the timer to start measuring the elapsed time from the moment of occurrence. The timepiece includes a display for displaying the elapsed time. The timepiece may be implemented digitally, and include a processor programmed to measure the elapsed time. Memory would also be provided for storing data associated with the personal life time event, including the time of occurrence of the event. A keypad would also be provided for entering and changing the stored data. The memory may include a non-volatile memory component in which is stored the time of occurrence of the personal life time event. The non-volatile memory would ensure recovery of the elapsed times in case of a power failure or some other event which causes loss of elapsed times.

9 Claims, 9 Drawing Sheets

LIFE TIME CLOCK

BACKGROUND OF THE INVENTION

1. Technical Field

The present invention relates generally to timepieces, and more particularly to timepieces and methods for measuring the elapsed time from the occurrence of one or more personal life time events.

2. Background Art

From the beginning of human civilization, society has been preoccupied with the passage of time. With the advent of the understanding of the concept of time, and the development of methods and devices for measuring time, society began to appreciate and record the history of events occurring around it. On a personal level too, it became important and desirable to note the occurrence of such events as birth, marriage, or the start of a career, profession, calling, vocation, pursuit, avocation, hobby, tenure, or regime, to name just a few examples. Such events are referred to herein as "personal life time events."

The celebrations of marriage and birth, for example, have become a universal tradition throughout the civilized world. Such celebrations usually occur on the anniversary date of such event. Such observances are as much a celebration of the original event as of the passage of time from such event.

The duration of a marriage, the age of an individual, or the tenure of an individual in a given profession, for example, is an important factor in how others view that marriage or the individual. Society generally recognizes as a noble achievement, that a marriage has lasted a long time. An individual is judged, in part, by his or her age, or by how long he or she has been practicing a given profession.

Notwithstanding this great attention society has directed to such personal life time events, heretofore, there has not been an attempt to monitor the elapsed times from the occurrence of such events. It would be an interesting and useful mechanism that provides a running account of the elapsed times from personal life time events. In one embodiment, an entire family tree could be presented which identifies each family member in his or her place in the genealogy of the family, together with his or her elapsed time from birth.

Timepieces for measuring elapsed time from given events are well known. Stop watches, such as described in U.S. Pat. No. 4,223,526 to Tanaka et al., permit the accurate timing of events from a starting point to a ending point. U.S. Pat. Nos. 5,285,430 to Decker, 5,058,085 to Lawler, 4,630,935 to Zettek, and 4,518,267 to Hepp disclose timepieces that measure elapsed times and time intervals from given events, none of which pertain to personal life time events as defined herein. These patents are primarily concerned with measuring the duration that a person has abstained from a particular activity or behavior, such as drinking or smoking. These patents are concerned with the achievement of a personal goal, e.g., to quit smoking or drinking. There is no suggestion in these patents that the elapsed time of a unique personal event, such as marriage or child birth, be measured.

In U.S. Pat. No. 5,031,161 to Kendrick, a timepiece is disclosed for displaying the approximate time remaining in a person's life, rather than the actual elapsed time from birth. The measurement of actual elapsed times from a personal life time event is not described or suggested.

OBJECTS AND SUMMARY OF THE INVENTION

It is therefore an object of the present invention to provide a running account of the elapsed time from an important personal life time event.

It is another object of the present invention to provide a timepiece and method for measuring the elapsed time from a personal life time event.

It is a further object of the present invention to provide a timepiece and method for measuring the life of a family from its inception at marriage, through the births of the issue from the marriage.

It is yet another object of the present invention to provide a timepiece from which the elapsed time from a personal life time event can be recovered if it is lost, by entering a current standard time into the timepiece.

It is yet a further object of the present invention to provide a timepiece for measuring the elapsed time from a personal life time event, wherein the timepiece can display the elapsed time in different units of time.

It is still another object of the present invention to provide a timepiece for measuring the elapsed time from a personal life time event, wherein the timepiece can be started at the precise moment of the event.

It is still a further object of the present invention to provide a timepiece for measuring the elapsed time from a personal life time event, wherein the timepiece can be implemented in a wide variety of embodiments including a watch, clock, personal organizer, computer screen saver, family tree, etc.

These and other objects are obtained in accordance with the present invention wherein there is provided, a timepiece for measuring the elapsed time of a personal life time event from the moment of occurrence of the event. The timepiece comprises a housing and a timer contained in the housing. The timer is configured for measuring the elapsed time of the personal life time event from its moment of occurrence. The timepiece includes a starting mechanism, operatively coupled to the timer, for causing the timer to start measuring the elapsed time of the personal life time event. The timepiece includes a display, operatively coupled to the timer, for displaying the elapsed time of the personal life time event.

In one embodiment, the personal life time event is the birth of an individual. In this embodiment, the timer is configured for measuring the elapsed time of the individual's life from the moment of his or her birth. The timer is started at the moment of birth of the individual. The display displays the elapsed time of the individual's life from birth.

In a preferred embodiment, the timepiece of the present invention may be implemented digitally. In such an embodiment, the timepiece would include a processor programmed to measure the elapsed time from the moment of occurrence of the personal life time event, upon actuation of the starting mechanism. Digital memory, operatively coupled to the processor, would also be provided for storing data associated with the personal life time event (e.g., the time of birth of an individual). A data entry device, such as a keyboard or keypad, would also be operatively coupled to the processor for entering and changing the stored data in the memory. In this embodiment, the display would be an electronic display device operatively coupled to said processor.

In the preferred digital implementation of the present invention, the memory includes a non-volatile memory component in which is stored the precise time of occurrence of each personal life time event to be measured (e.g., the time of birth of the individual). The non-volatile memory ensures recovery of the elapsed times for each personal life time event in case of a power failure or some other event which causes the loss of the elapsed times. The processor is programmed such that the current elapsed times can be recovered by entering a current standard time through the data entry device. In this embodiment, the processor is programmed to: (1) call the time of occurrence data from the non-volatile memory; (2) receive from the data entry device, a current standard time entered by a user; and (3) compute, from the time of occurrence data and the standard time, the current elapsed time for each personal life time event.

In the digital implementation, the processor may be programmed to represent the elapsed times of the personal life time events in different units of time, including seconds, minutes, hours, days, weeks, months, and years. These different units of time may be displayed separately by the electronic display device. Alternatively, some or all of the time units may be displayed simultaneously by the electronic display device.

A sound transducer, such as a speaker, may be operatively coupled to the timer. In such case, the timer could be configured to generate an audible signal (e.g., a musical tune) over the sound transducer on each birthday of the individual being timed, or on each anniversary of a marriage being timed. In addition, a message could be generated on the display device, advising a viewer of a birthday or anniversary.

In an alternative embodiment, the timepiece of the present invention could be configured to simply measure the life of a marriage from the moment of wedlock. Such a timepiece would be configured as described above, having a housing, timer, starting mechanism, and a display.

In another alternative embodiment, the timepiece of the present invention could be configured to measure the life of a family from its inception at marriage through the births of the issue from the marriage. Such a timepiece would include the combined capability of independently measuring the life of the original marriage, the separate lives of the issue resulting from the marriage, and the lives of the marriage partners (i.e., spouses). In such an embodiment, the timepiece would comprise a housing, a timer having the capability of independently timing a plurality of events, a starting mechanism for starting the independent timing of each of the events, and a display for displaying the elapsed time for each of the events.

The timepiece of the present invention may be embodied in any of a wide variety of forms including a wristwatch, wall clock, mantel clock, personal computer screen saver, an album which opens up to a picture frame and display screen, an anniversary plate or dish, a family tree plaque, a personal electronic organizer, etc.

Methods of monitoring the life of a family or of a personal life time event are also contemplated by the present invention. These methods comprise the steps of (1) employing a timer; (2) starting the timer at the precise moment of the personal life time event; (3) measuring the elapsed time from the moment of occurrence of the event; and (4) displaying the elapsed time for the event from the moment of occurrence.

BRIEF DESCRIPTION OF THE DRAWING

Further objects of the present invention will become apparent from the following description of the preferred embodiments with reference to the accompanying drawing, in which.

DESCRIPTION OF THE PREFERRED EMBODIMENTS

Figure 1:
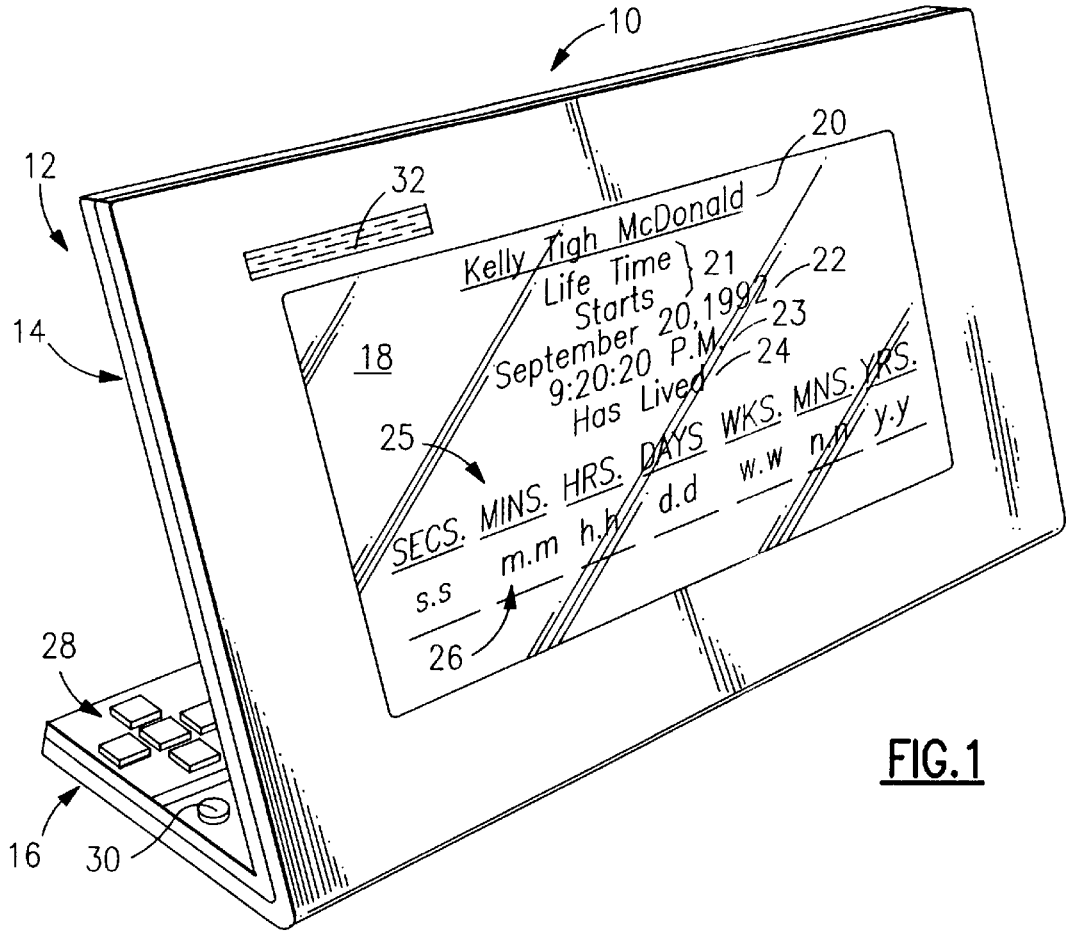
FIG. 1 is a perspective view of one embodiment of the timepiece of the present invention, configured with a large electronic display.

With reference to FIG. 1, there is shown a timing apparatus or timepiece 10 constructed in accordance with the present invention. Timepiece 10 is configured to measure the elapsed time from the moment of occurrence of a personal life time event. As used herein the term "personal life time event" is intended to mean such personal events as: birth; marriage; the start of a career, profession, calling, vocation, pursuit, avocation, hobby, tenure, or regime; and similar events occurring in a person's life. It is within the scope of the invention that a timepiece be configured to measure any one, or a plurality, of these personal life time events.

For example, a timepiece, constructed in accordance with the present invention, could be configured as a lawyer's or doctor's clock, which measures the elapsed time from the start of a person's career as a lawyer or doctor. Similarly, clocks could be configured for measuring the elapsed time from the start of other professions and callings such as accountants, MBAs, teachers, professional athletes, priests, rabbis, etc. As an other example, the timepiece of the present invention could be configured as a life time clock, which would measure the elapsed time from the birth of a person. Similarly, a marriage clock could be configured to measure the elapsed time from the moment of wedlock.

As shown in FIG. 1, timepiece 10 comprises a plastic housing 12 which includes an upright display portion 14 and a flat base portion 16. Housing 12 contains an electronic timer or processor (not shown in FIG. 1) which is designed to measure the elapsed time from a particular personal life time event. In FIG. 1, the personal life time event displayed is the birth of Kelly Tigh McDonald.

As shown in FIG. 1, timepiece 10 further comprises an electronic display 18 which may be, for example, a liquid crystal display (LCD) or a gas plasma display. Display 18 displays a name 20 of the individual whose life time is being monitored. Display 18 also displays form text 21, date of birth text 22, time of birth text 23, form text 24, time unit headings 25, and the current elapsed time 26 from birth, in different units of time.

With further reference to FIG. 1, timepiece 10 also includes a data entry device, such as a keypad 28, for programming and operating timepiece 10. Timepiece 10 may also include a dedicated start/reset button 30 which, when depressed, triggers or restarts the timekeeping function of the timer chip or processor contained in timepiece 10. In an alternate implementation, this start/reset function could be realized via keypad 28.

Typically, timepiece 10 may further include a sound transducer, such as a speaker 32. Speaker 32 is used to produce audible signals, including musical tunes, which are pre-programmed in the processor of timepiece 10. For example, the processor could be programmed to generate an appropriate musical tune over speaker 32, on a birthday or anniversary.

Figure 2:
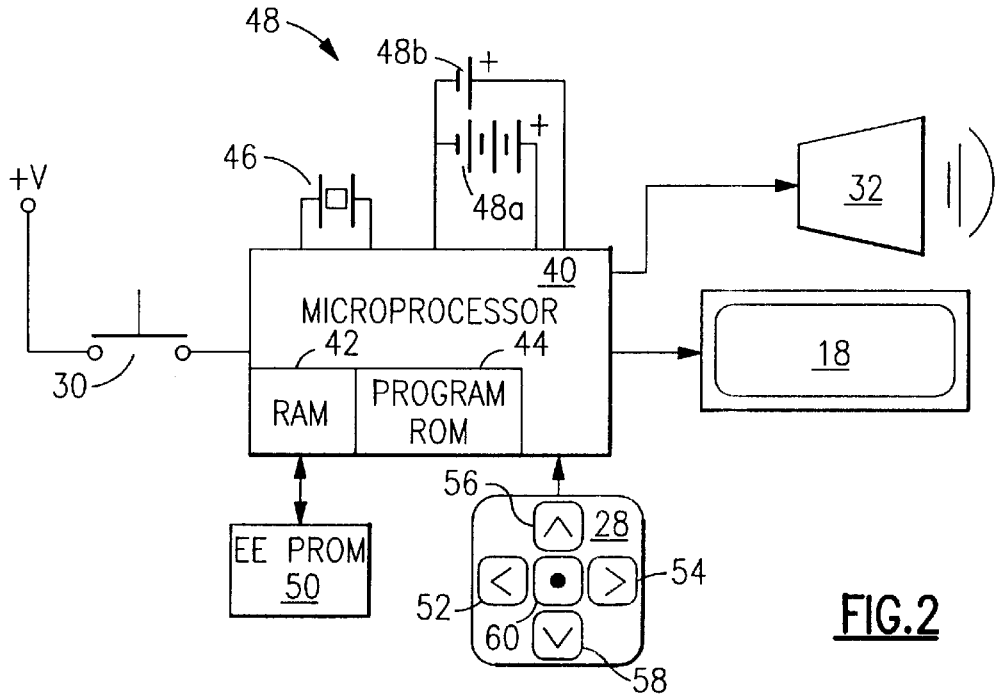
FIG. 2 is a block diagram of one implementation of the timepiece of the present invention.

Referring now to FIG. 2, there is shown a block diagram of the basic functional components of timepiece 10. At the heart of timepiece 10 is a microprocessor unit 40 which includes a RAM 42, a program ROM 44, an oscillator-based system clock circuit 46, and a power supply 48. Microprocessor unit 40 may also include dividing and decoding functions which are normally utilized in the digital timepiece art. The operating program for microprocessor unit 40 is stored in program ROM 44. Clock circuit 46 generates a timing signal used to operate microprocessor 40, and serves as a reference to synchronize other circuits as required. Power supply 48 comprises a primary battery 48*a* and a backup battery 48*b*. Backup battery 48*b* provides sufficient reserve power to maintain the timekeeping function of processor 40 should primary battery 48*a* expire. In other embodiments of the present invention, power supply 48 may be an A.C. to D.C. power converter, enabling timepiece 10 to be powered by a standard 110 volt A.C. outlet.

With further reference to FIG. 2, a non-volatile memory component 50 is operatively connected to microprocessor 40 for safe, non-volatile storage of personal life time event data, such as, for example, the precise time of birth and/or wedlock, and other basic information as displayed in FIG. 1. Such personal life time event data is entered via keypad 28 and stored in non-volatile memory component 50, in a data entry mode. Non-volatile memory component 50 may be in the form of an electrical erasable programmable read only memory (EEPRROM) or a static random access memory (SRAM) backed up by a battery.

Again referring to FIG. 2, there is shown start/reset button 30 which functions as a switch between microprocessor 40 and a priority interrupt voltage signal +V. When button 30 is depressed, interrupt signal +V is applied to microprocessor 40. Microprocessor 40 is programmed to start or restart an elapsed timekeeping function upon application of interrupt signal +V thereto. As indicated above, this start/restart function may be alternatively implemented through keypad 28.

As shown in FIG. 2, display 18, keypad 28, start/reset circuit 30, speaker 32, clock circuit 46, power supply 48, and non-volatile memory 50 are all operatively connected to microprocessor 40. The output of microprocessor 40 is displayed on display 18 via a display driver (not shown) in a manner well known in the art.

As indicated previously, data concerning a personal life time event to be timed is programmed into timepiece 10 by the user through keypad 28, in a data entry mode. The data entry mode may be configured in any manner suitable for entering personal life time event data. As an example of one data entry approach, keypad 28 may be defined as having four cursor keys 52, 54, 56, and 58 surrounding a mode key 60 (See FIG. 2). In this example, a number of modes are supported, including: message entry (e.g., name of individual whose life is being timed—See entry 20 in FIG. 1); event date entry (e.g., See entry 22 in FIG. 1); event time entry (e.g., See entry 23 in FIG. 1); current date entry; current time entry; and selection of the display format (e.g., time units to be displayed).

In the data entry mode, the left and right cursors, 52 and 54, select the column or field. Cursors 52 and 54 are inactive in the display mode. The up and down cursors, 56 and 58, rotate through the appropriate sequence for the column or field, in data entry modes, and sequence through pre-defined display formats in the display mode. As an example of this process, FIGS. 3A–3D illustrate the entry of a personal life time event date (i.e., a birth date). As shown in FIGS. 3A–3D, the data entry mode is identified on a line 22*a*, and the date fields are displayed on line 22*b*.

Figure 3A:
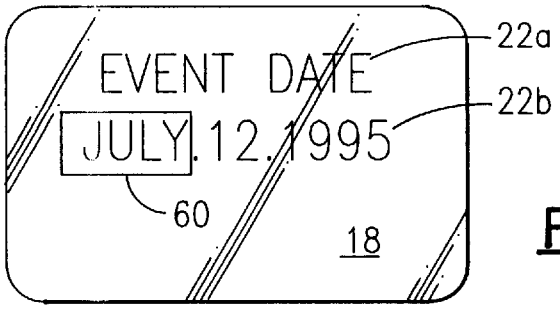
FIGS. 3A–3D are diagrams showing an example of the display for the timepiece, and illustrating a data entry mode.
Figure 3B:
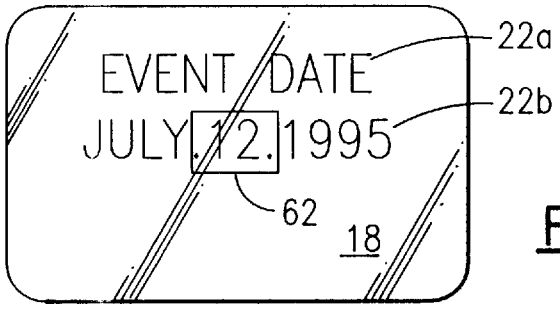
Figure 3C:
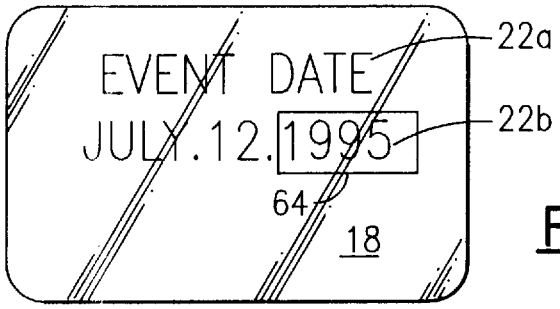

As shown in FIG. 3A, a month field 60 is activated, and the months of the calendar year are sequenced through by use of cursors 56 and 58. As shown FIG. 3B, the day field is selected by pressing cursor key 54, and the days of the month are sequenced through by use of cursors 56 and 58. As shown in FIG. 3C, the year field is selected by pressing cursor key 54, and the correct year is selected by use of cursors 56 and 58.

Figure 3D:
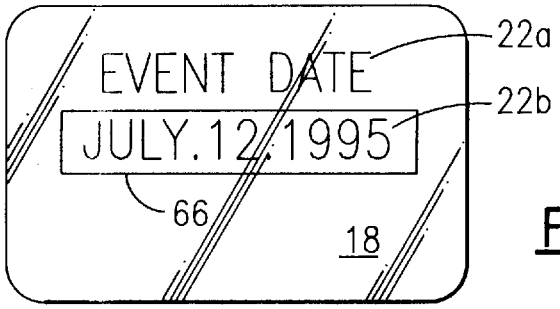

To protect the entered data against accidental changes, the data entry modes include a verification state during which the completed entry 66 flashes (See FIG. 3D). If both cursor keys 56 and 58 are not held down for approximately 0.5 seconds, the flashing stops and the changes are ignored. However, if both cursor keys 56 and 58 are held down for approximately 0.5 seconds, the flashing stops, the data change is accepted, and the display reflects the new data.

Figure 4:
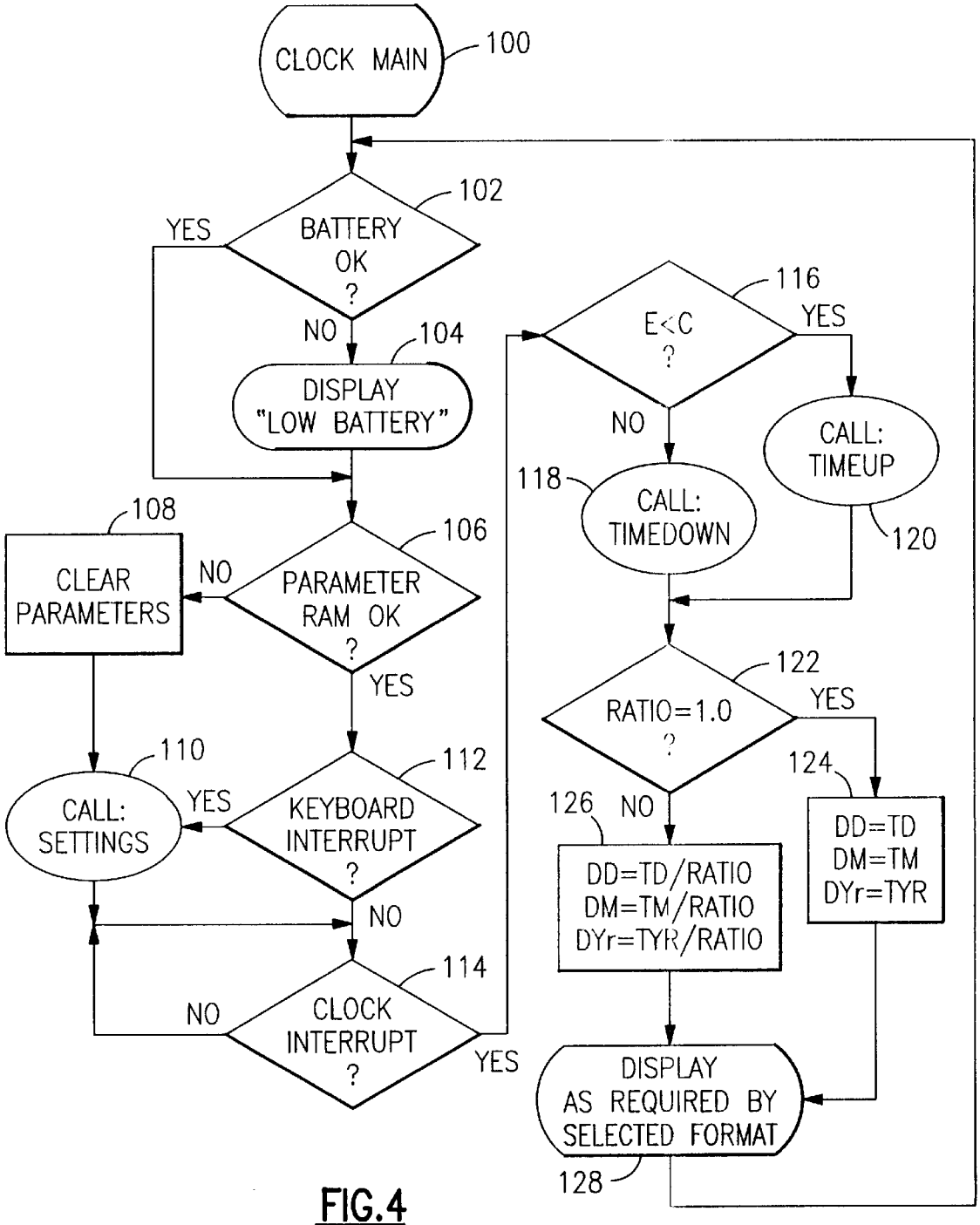
FIG. 4 is a flow chart of the timekeeping operation of the timepiece of FIG. 2.

Referring now to FIG. 4, there is shown a flow chart of the timekeeping operation of microprocessor 40. Upon initial start-up, microprocessor 40 is directed to a starting or entry point 100, referred to in FIG. 4 as "Clock Main." In a next step 102, there is a check to determine if battery 48*a* is low. If low, an instruction to display a "Low Battery" message on display 18 is executed in a step 104. In a next step 106, there is a check to see if the information in RAM 42 is valid. If not, RAM 42 is cleared in step 108, and a function referred to as "Settings" is called in a step 110. If RAM 42 contains valid data, there is a check to determine whether there has been a keyboard interrupt by a user, in a step 112. If there is a keyboard interrupt, "Settings" is called (step 110). Accordingly, under initial start-up, user initiated reset, or upon a reset required by battery replacement, RAM 42 is cleared.

Under step 110, the user is prompted to enter or re-enter the necessary personal life time event data via a call to the "Settings" function. "Settings" calls a number of routines (not shown) necessary to collect the required information, such as the event date and time, event message, current date and time, display format, etc. The Settings function completes its process with a call to a calculation function referred to as "Precalc" (not shown). The Precalc function performs a calculation of the difference between the entered event date and time and the entered current date and time, to compute an initial elapsed time or "Time Delta." At the completion of the Precalc function, and the subsequent return from the Settings call, the timekeeping operation begins.

Upon return from the Settings call, or if there has not been a keyboard interrupt by a user (step 112), there is next a check to determine if a clock interrupt signal has been received from clock circuit 46, in a step 114. If so, the timing operation begins. If not, the process continues in a loop until a clock interrupt has been received. Once a clock interrupt is received, a determination is made as to whether the stored event date and time is later than the current date and time, in a step 116. If so, it is assumed that a countdown timing mode is desired, and the Time Delta is decremented by one second (a clock interrupt occurs in one-second intervals) under operation of a "Timedown" routine 118. If the stored event date and time is earlier than the current date and time (step 116), it is assumed that a count-up timing mode is desired. In the count-up mode, the Time Delta is incremented by one second under operation of a "Timeup" routine 120. In each of the Timedown and Timeup routines, modulus arithmetic is used to dynamically supply the correct number of elapsed years, months, days, hours, minutes, and seconds, and to accommodate leap years, if necessary.

After the timekeeping function (i.e., decrementing or incrementing the Time Delta), a check may be made, in an optional step 122, to see if a ratio or factor has been entered to alter the standard rate of time. Such an option may be desirable as a novelty, for tracking elapsed times at an animal's aging rate (See, for example, U.S. Pat. No. 5,023,850). If no such ratio is entered, the ratio is assumed to be one (1), and the standard time elapsed (from an event) or time remaining (to an event) is formatted for display in a step 124. If a ratio was entered, the elapsed time or remaining time is adjusted accordingly for display, in a step 126. In a step 128, the information is transferred for display, in a user selected format, to display device 18.

Returning now to the starting function triggered by start/reset button 30, a standard time clock function (not shown) is implemented in microprocessor 40 (or by an independent clock circuit) to provide the current date and time for calculating the Time Delta. The user must initially set the time clock and start it running before the starting function can be accurately employed. Once the clock is set and running, and the event date and time are entered, start/reset button 30 can be depressed, causing an interrupt to trigger a call to the clock output. The clock output is then used in the Time Delta calculation performed by the Precalc function as described above.

As indicated above, non-volatile memory component 50 is used to provide a safe storage location for the date and time of occurrence of the particular personal life time event. Microprocessor 40 is programmed to call such personal life time event data from memory component 50 (e.g., via RAM 42) in connection with the Precalc function described above. In the event that there is a power failure, or some other event which causes the loss of the elapsed time (or remaining time) for a particular personal life time event, the current elapsed time (or remaining time) can be re-calculated by the Precalc function, by entering a current standard time (e.g., the Greenwich mean time) through keypad 28 under operation of the Settings function.

Display formats can be selected by the user under the Settings function. The elapsed time (or time remaining) can be displayed on display 18 in different units of times. For example, in FIG. 1, display 18 is shown displaying the elapsed time from the birth of Kelly Tigh McDonald, in units of seconds, and simultaneously, in units of minutes, hours, days, weeks, months, and years. In another display format, the different units of time can be displayed separately (i.e., one-at-a-time) by scrolling with cursor keys 56 and 58.

To realize the feature of producing musical tunes and displaying announcements on birthdays and anniversaries, such data could be pre-stored in program ROM 44 or EEPROM 50. Such data could be called up in the Timeup routine, for example, upon reaching a one year increment of the original Time Delta, or at one year intervals from the time of occurrence of the particular personal life time event.

Of course, microprocessor 40 can be programmed to monitor a number of different personal life time events to support, for example, a family tree embodiment.

Figure 5:
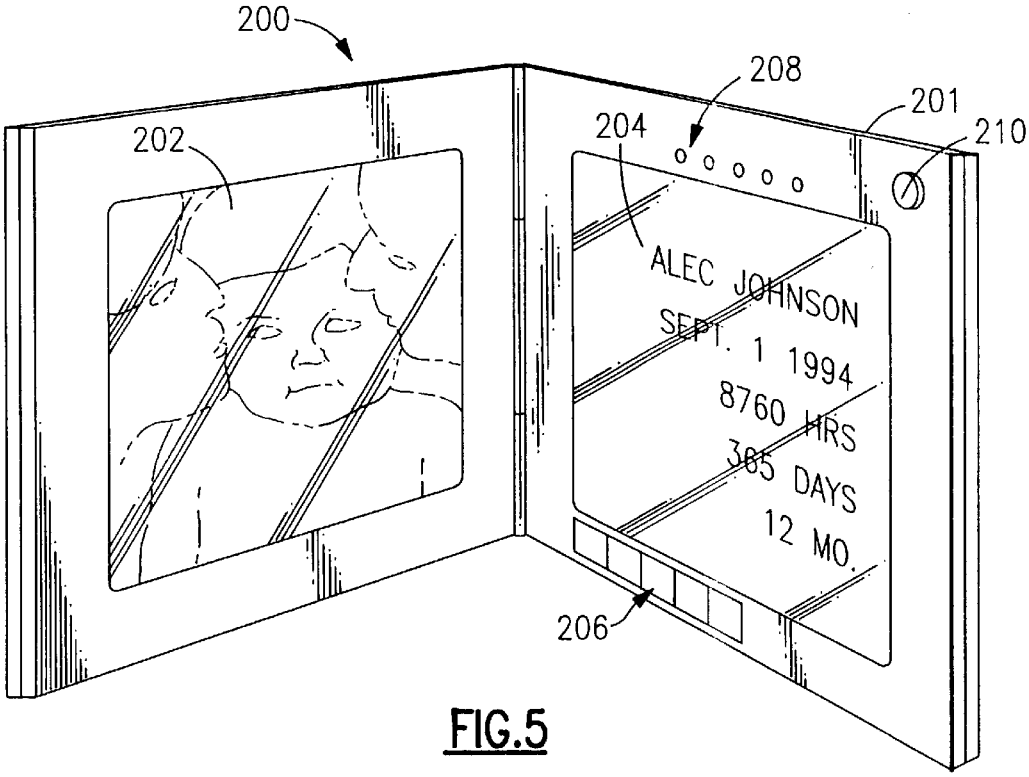
FIG. 5 is a perspective view of a second embodiment of the present invention, configured as an album.

Referring now to FIG. 5, there is shown a second embodiment of the present invention, configured as an album 200. Album 200 opens up to a picture frame 202 and an electronic display 204, and includes a keypad 206, a speaker 208, and start/reset button 210. The microprocessor or timer chip, program ROM, EEPROM, RAM, crystal oscillator-based clock circuit, speaker, and battery (hereinafter "timepiece components") are contained in housing 201.

Figure 6:
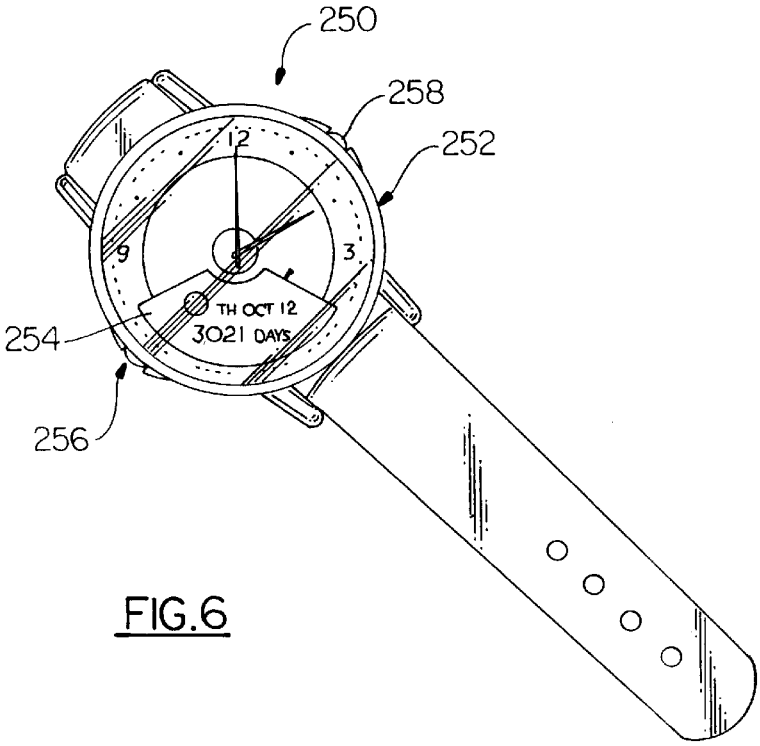
FIG. 6 is a plan view of a third embodiment of the present invention, configured as a wristwatch.

FIG. 6 illustrates a third embodiment of the present invention, configured in the form of a wristwatch 250. Wristwatch 250 includes a watch casing 252 containing the timepiece components, an electronic display 254, a settings button 256, and a start/reset button 258.

Figure 7:
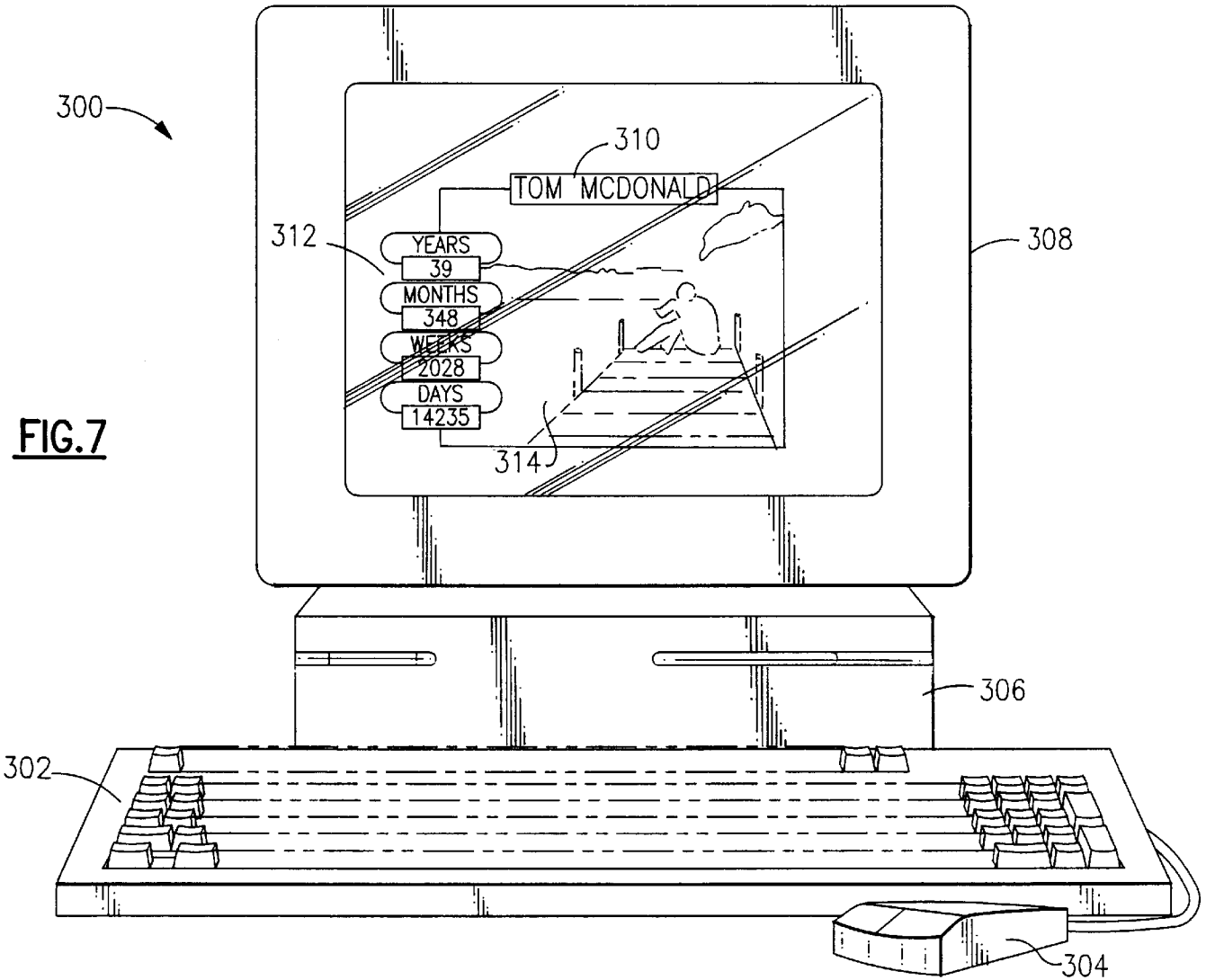
FIG. 7 is an elevation view of a fourth embodiment of the present invention, configured as a personal computer screen saver.

FIG. 7 shows a fourth embodiment of the present invention, configured in a personal computer 300 as a screen saver. Computer 300 includes a keyboard 302, a mouse 304, a computer housing 306, and a CRT or monitor 308. The display for the timepiece of the present invention is generated on the screen of CRT 308, and includes an annotation or message area 310, a timekeeping area 312, and a background image area 314. The display appears on the screen of CRT 308 periodically, in accordance with a screen saver program. The timepiece components may be realized from the standard components of personal computer 300 contained in housing 306.

Figure 8A:
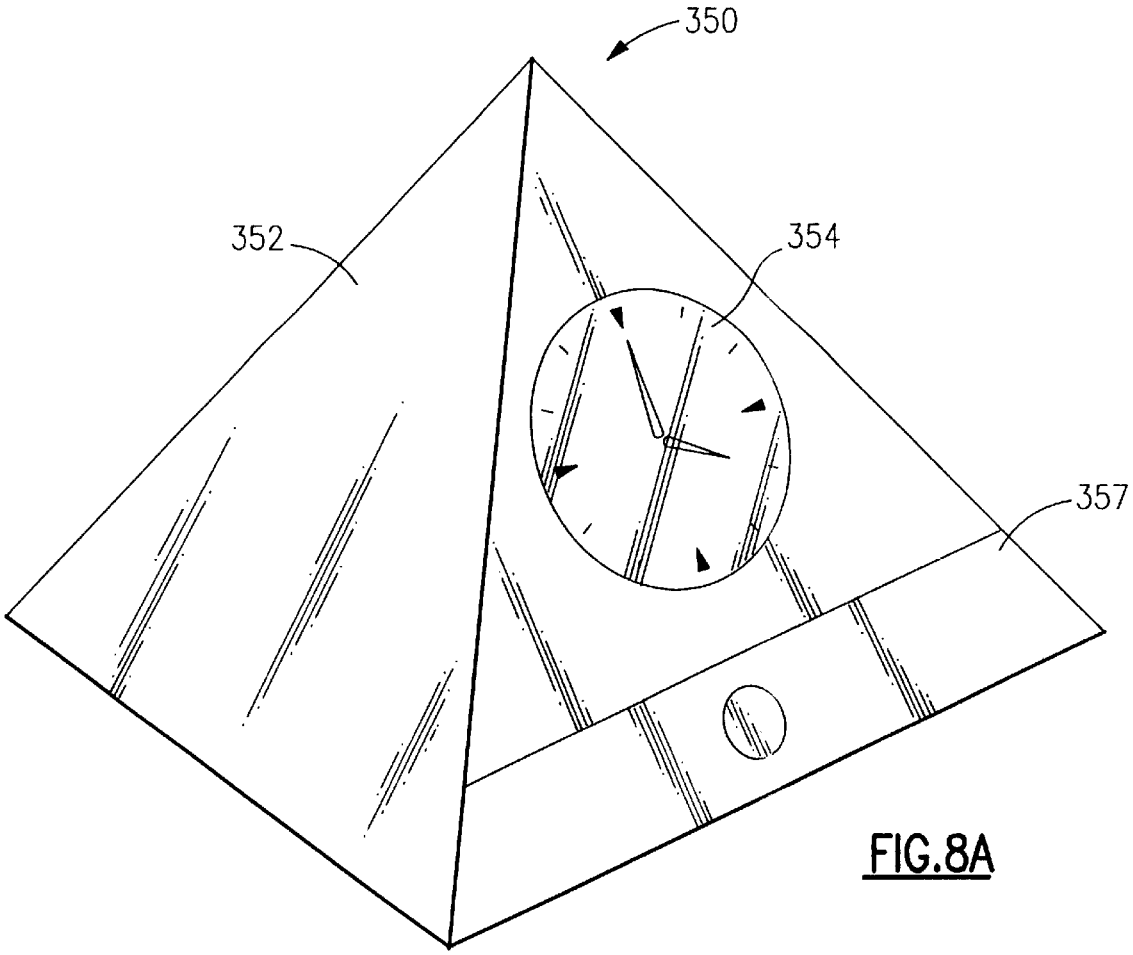
FIG. 8A–8B are perspective views of a fifth embodiment of the present invention, configured as a pyramid-shaped clock.
Figure 8B:
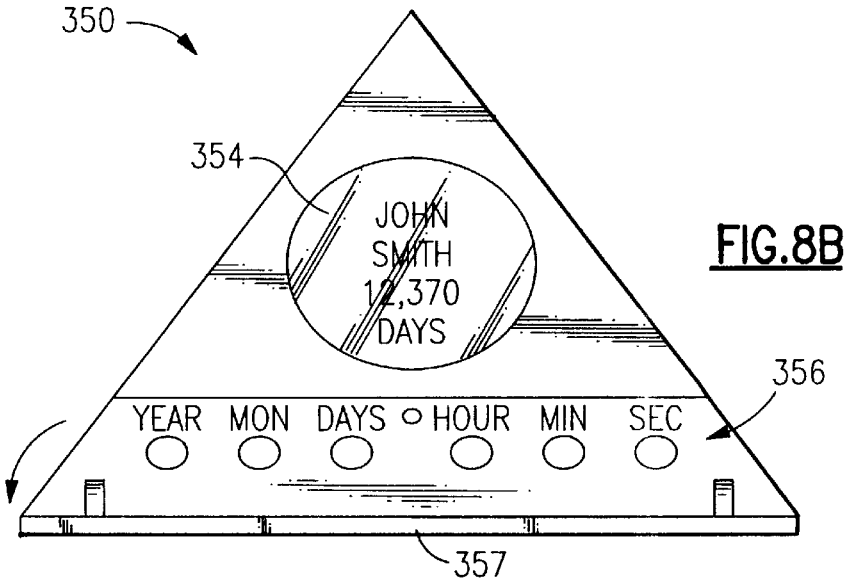

FIGS. 8A–8B show a fifth embodiment of the present invention, configured as a pyramid-shaped clock 350. Clock 350 includes a pyramid-shaped housing 352 containing the timepiece components, an electronic display 354, and a control panel 356. Control panel 356 contains buttons for selecting different time units to be displayed. A panel door 357 drops down on hinges to expose control panel 356 for use. A keypad is located on the other side of clock 350 (not shown), and configured similarly to control panel 356.

Figure 9:
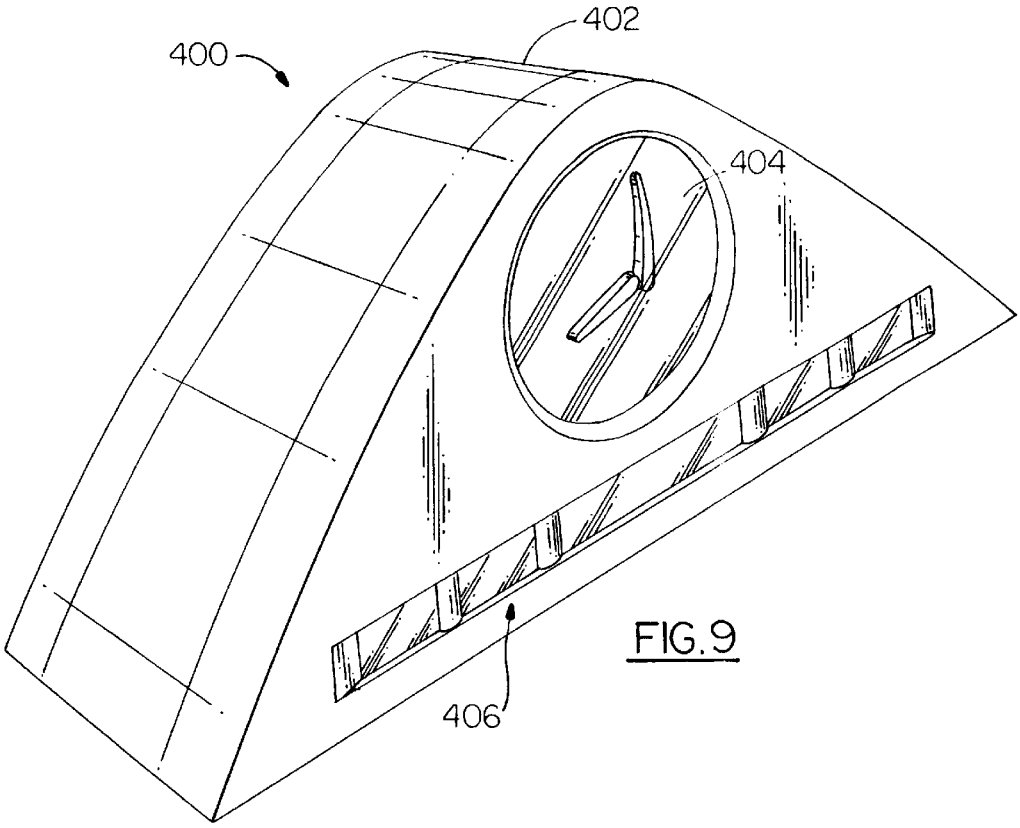
FIG. 9 is a perspective view of a sixth embodiment of the present invention, configured as a mantel clock.

FIG. 9 shows a sixth embodiment of the present invention, configured as a mantel clock 400. Clock 400 includes a housing 402 containing the timepiece components, a standard clock function and face 404, and five electronic displays 406. Electronic displays 406 are LCD screens showing elapsed time in different units of time, and a "Happy Anniversary" message. A keypad for data entry and the starting of timekeeping, is contained on the back of housing 402.

Figure 10:
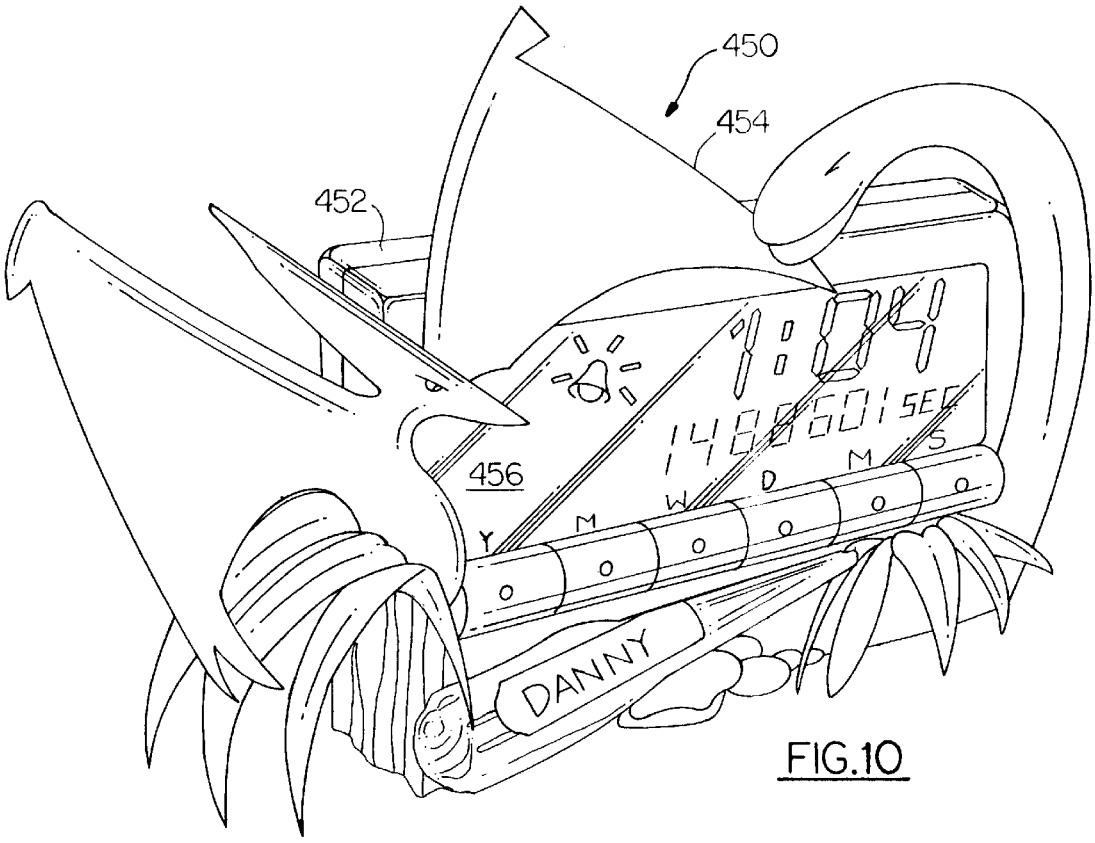
FIG. 10 is a perspective view of a seventh embodiment of the present invention, configured as a child's clock.

FIG. 10 shows a seventh embodiment of the present invention, configured as a child's clock 450. Clock 450 includes a housing 452 containing the timepiece components, a facade 454 which removably snaps into place on the front of housing 452 and can be replaced with other facades, and an LCD display 456. In addition to the timekeeping functions of the present invention, clock 450 includes a standard clock function as indicated on display 456. The selected display format for the elapsed time is in units of seconds. A keypad for data entry and the start of timekeeping is contained on the back of housing 452.

Figure 11:
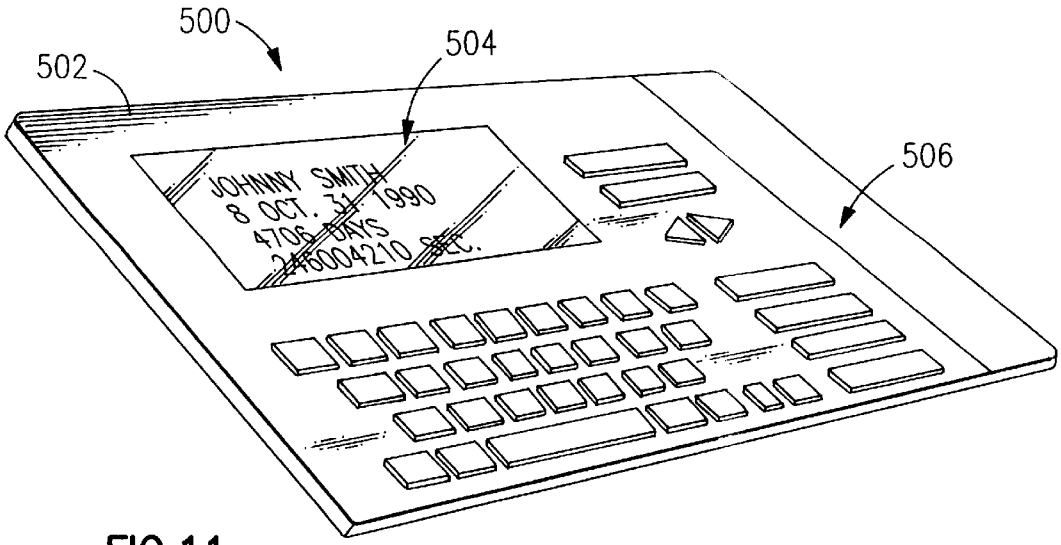
FIG. 11 is a perspective view of an eighth embodiment of the present invention, configured as a personal electronic organizer.

FIG. 11 shows an eighth embodiment of the present invention, configured as a personal electronic organizer 500.

Electronic organizer 500 includes a housing 502 containing the timepiece components, a display 504, and a keyboard 506. Display 504 displays the name of an individual, Johnny Smith, his birth date, and the elapsed time since his birth in units of seconds and days.

Figure 12:
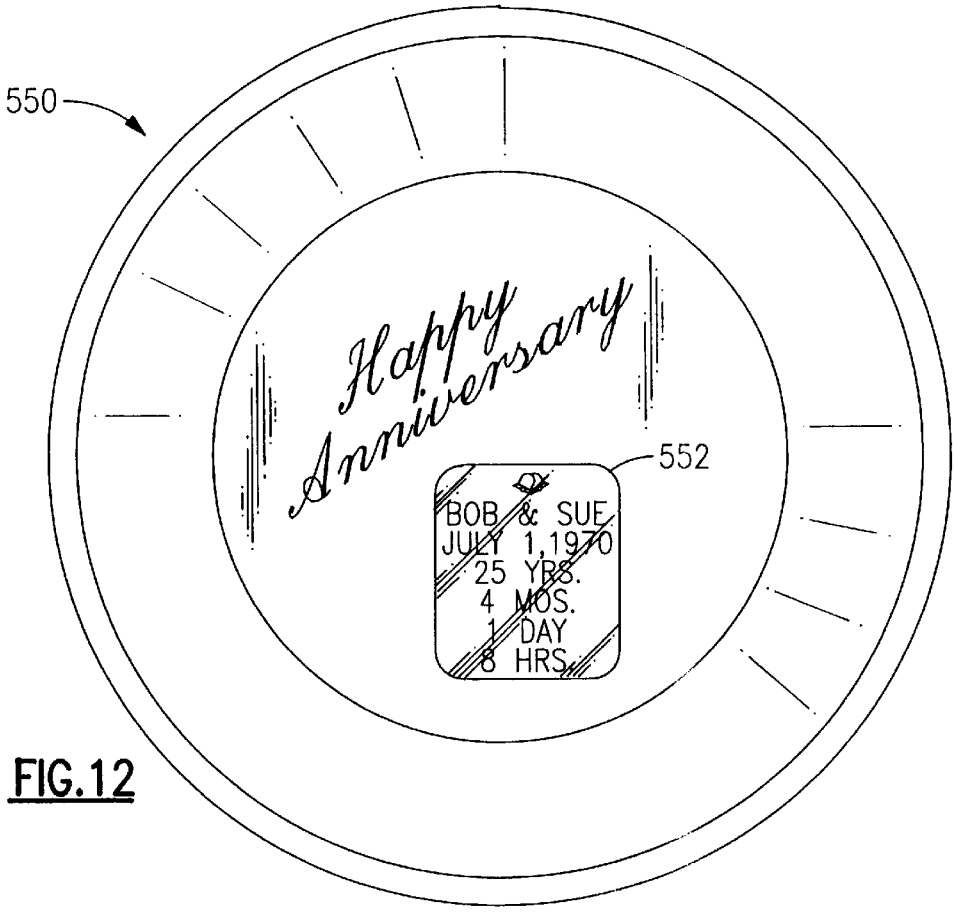
FIG. 12 is a plan view of a ninth embodiment of the present invention, configured in combination with an anniversary plate.

FIG. 12 shows a ninth embodiment of the present invention, configured in combination with a display article which, in this case, is an anniversary plate 550. The timepiece components are contained in a rectangular housing 552, the front panel of which constitutes an LCD display. The rear panel of housing 552 contains a keypad (not shown) which allows for data entry and starting. Housing 552 is removably mounted in a cavity contained in the front face of plate 550.

Figure 13:
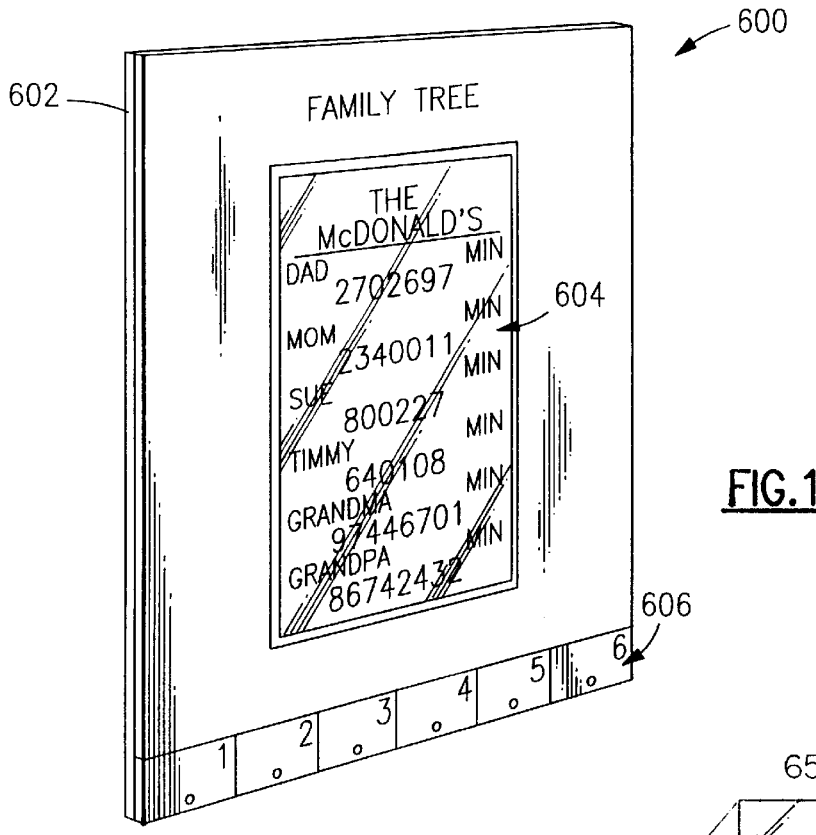
FIG. 13 is a perspective view of a tenth embodiment of the present invention, configured as an electronic family tree tablet.

FIG. 13 shows a tenth embodiment of the present invention, configured as an electronic family tree tablet 600. Tablet 600 is suitable for hanging on a wall. It includes a housing 602 containing the timepiece components, a display 604, and a keypad 606. As shown, elapsed time data is displayed for each member of a family.

Figure 14:
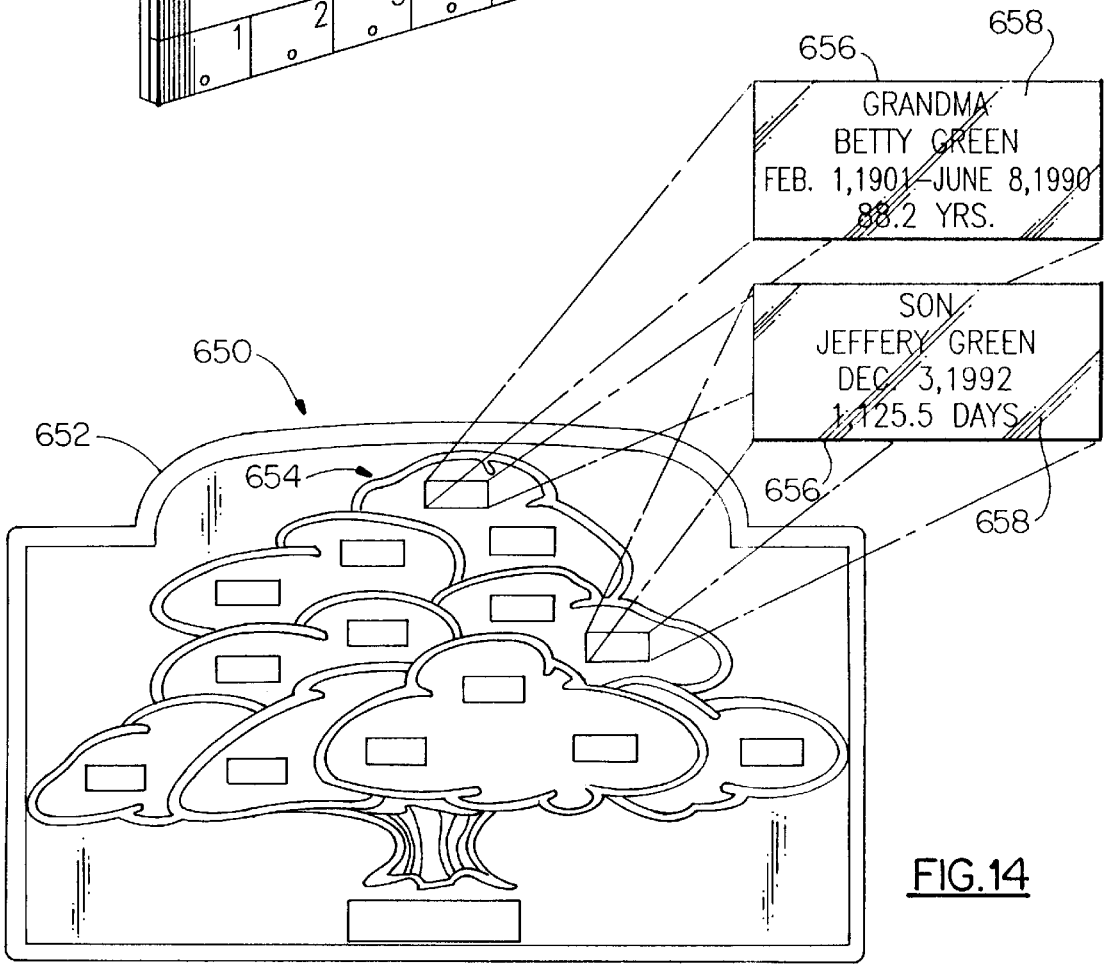
FIG. 14 is an elevation view of an eleventh embodiment of the present invention, configured as family tree plaque.

FIG. 14 shows an eleventh embodiment of the present invention, configured in combination with a display article which, in this case, is a family tree plaque 650. Plaque 650 includes a plaque base 652 and a tree design carving 654. Carving 654 is carved into either base 652 or a separate piece of wood mounted on base 652. Carving 654 contains a number of timepiece units 656 constructed in accordance with the present invention—one for each member of the family being represented in the family tree. Each timepiece unit 656 is mounted in a cavity routed in carving 654. Each timepiece unit 656 contains the timepiece components and includes an LCD display 658. On the back of each unit 656 is a keypad (not shown) for data entry and starting functions. In an alternative implementation, a single timepiece (in accordance with the present invention) could be centrally located in or on base 652 and connected to a number of display units 656 for displaying data on each member of the family.

It is to be understood that the present invention is not limited to the microprocessor implementation as hereinabove described. For example, application specific integrated circuits may be designed or configured for carrying out the present invention.

While the preferred embodiments of the invention have been particularly described in the specification and illustrated in the drawing, it should be understood that the invention is not so limited. Many modifications, equivalents, and adaptations of the invention will become apparent to those skilled in the art without departing from the spirit and scope of the invention as defined in the appended claims.

What we claim is:

1. A method of monitoring the elapsed time from the occurrence of a personal life time event which is associated with an individual or individuals, said method comprising the steps of:

(a) employing a timer;

(b) starting said timer at the moment of occurrence of said personal life time event;

(c) measuring the elapsed time from the moment of occurrence of said event, using said timer;

(d) displaying the current elapsed time in units which include hours, minutes or seconds; and (e) displaying, adjacent to the displayed current elapsed time, a name of the individual or individuals with which said event is associated.

2. The method of claim 1, further comprising the step of:

(f) displaying the date of occurrence of said personal life time event.

3. A method of monitoring the elapsed time from the moment of birth of an individual, said method comprising the steps of:

(a) employing a timer;

(b) starting said timer at the moment of birth of the individual;

(c) measuring the elapsed time from the moment of birth, using said timer;

(d) displaying the current elapsed time in units which include hours, minutes or seconds; and (e) displaying, adjacent to the displayed current elapsed time, a name of the individual.

4. The method of claim 3, further comprising the step of:

(f) displaying the date of birth of the individual.

5. A method of monitoring the elapsed time from the moment of wedlock of a couple of individuals, said method comprising the steps of:

(a) employing a timer;

(b) starting said timer at the moment of wedlock;

(c) measuring the elapsed from the moment of wedlock using said timer;

(d) displaying the current elapsed time in units which include hours, minutes or seconds; and (e) displaying, adjacent to the displayed current elapsed time, a name or names of the couple.

6. The method of claim 5, further comprising the step of:

(f) displaying the date of wedlock of the couple.

7. A method of monitoring the elapsed time from the occurrence of a personal life time event which is associated with an individual or individuals, said method comprising the steps of:

(a) employing a timer;

(b) starting said timer at the moment of occurrence of said personal life time event;

(c) measuring the elapsed time from the moment of occurrence of said event using said timer;

(d) displaying the current elapsed time in units which include hours, minutes or seconds;

(e) displaying, adjacent to the displayed current elapsed time, the date of occurrence of said event; and (f) displaying a name of the individual or individuals with which said personal life time event is associated.

8. A method of monitoring the elapsed times of a plurality of personal life time events which are associated with a plurality of individuals, respectively, said method comprising the steps of:

(a) employing a plurality of timers;

(b) starting said timers at the moments of occurrence, respectively, of said personal life time events;

(c) measuring the elapsed times from the moments of occurrence of said events, respectively, using said timers;

(d) displaying the current elapsed times in units which include hours, minutes or seconds;

(e) displaying, adjacent to the displayed current elapsed times, the names of the plurality of individuals with which said personal life time events are associated; and (f) mounting said plurality of timers on a display article.

9. A method of monitoring the elapsed times of a plurality of personal life time events which are associated with a plurality of individuals, respectively, said method comprising the steps of:

(a) employing a plurality of timers;

(b) starting said timers at the moments of occurrence, respectively, of said personal life time events;

(c) measuring the elapsed times from the moments of occurrence of said events, respectively, using said timers;

(d) displaying the current elapsed times in units which include hours, minutes or seconds;

(e) displaying the dates of occurrence of said personal life time events adjacent to the displayed current elapsed times;

(f) displaying a name of at least one of said plurality of individuals with which at least one of said events is associated; and (g) mounting said plurality of timers on a display article.

* * * * *

UNITED STATES PATENT AND TRADEMARK OFFICE

CERTIFICATE OF CORRECTION

PATENT NO. : 6,069,848
DATED : May 30, 2000
INVENTOR(S) : McDonald et al.

It is certified that error appears in the above-identified patent and that said Letters Patent is hereby corrected as shown below:

Column 10, on line 25:

insert the word --time-- between "elapsed" and "from"

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*